US008810158B2

(12) United States Patent
Koppelaar et al.

(10) Patent No.: US 8,810,158 B2
(45) Date of Patent: Aug. 19, 2014

(54) MESSAGE CONTROLLABLE LAMP

(75) Inventors: Arie Geert Cornelis Koppelaar, Giessen (NL); Oswald Moonen, Eindhoven (NL); Emmanuel David Lucas Michael Frimout, Nuenen (NL); Aly Aamer Syed, Deurne (NL); Paul Mattheijssen, Eindhoven (NL); Ewout Brandsma, Eindhoven (NL); Gert-Jan Koolen, Aarle Rixtel (NL)

(73) Assignee: NXP, B.V., Eindhoven (NL)

( * ) Notice: Subject to any disclaimer, the term of this patent is extended or adjusted under 35 U.S.C. 154(b) by 215 days.

(21) Appl. No.: 13/263,731

(22) PCT Filed: Apr. 7, 2010

(86) PCT No.: PCT/IB2010/051496

§ 371 (c)(1),
(2), (4) Date: Jan. 11, 2012

(87) PCT Pub. No.: WO2010/116327

PCT Pub. Date: Oct. 14, 2010

(65) Prior Publication Data

US 2012/0098428 A1 Apr. 26, 2012

(30) Foreign Application Priority Data

Apr. 8, 2009 (EP) ..... 09157578

(51) Int. Cl.
*G05F 1/00* (2006.01)

(52) U.S. Cl.
USPC ..... 315/307

(58) Field of Classification Search
USPC ..... 315/117, 119, 291, 307, 185 R, 247, 41, 315/43
See application file for complete search history.

(56) References Cited

U.S. PATENT DOCUMENTS 5,352,957 A 10/1994 Werner
6,477,602 B1 11/2002 Loison (Continued)

FOREIGN PATENT DOCUMENTS

CN 2449390 9/2001
CN 2467518 Y 12/2001

(Continued)

OTHER PUBLICATIONS

Office action for CN appln. No. 101080016075.9 (Jul. 31, 2013).

(Continued)

*Primary Examiner* — Minh D A

(57) ABSTRACT

A lamp is provided that is controlled by messages transmitted via a network. The lamp has an internal memory that stores an address and an internal control circuit that responds to received messages that refer to this address. The address is updated when the lamp is installation in a power supply socket, using for example an address from the first message that is transmitted after installation. The lamp contains a detector that detects disconnection of the lamp from the power supply socket, for example by monitoring a resistance value between two parts of one of the power supply terminals of the lamp. In response to this detection the control circuit of the lamp sets information that enables an update of the address in the memory. When it is detected that the lamp is again connected to a power supply socket the address is updated on condition that the update is enabled.

14 Claims, 2 Drawing Sheets

(56) References Cited

U.S. PATENT DOCUMENTS

| | | | | |
|---|---|---|---|---|
| 6,847,170 | B2 * | 1/2005 | Kayser | 315/117 |
| 7,344,279 | B2 * | 3/2008 | Mueller et al. | 362/294 |
| 2005/0258765 | A1 | 11/2005 | Rodriguez et al. | |
| 2006/0154642 | A1 * | 7/2006 | Scannell, Jr. | 455/404.1 |
| 2007/0211461 | A1 * | 9/2007 | Harwood | 362/232 |
| 2008/0228508 | A1 * | 9/2008 | Lyons et al. | 705/1 |
| 2011/0169606 | A1 | 7/2011 | Brandsma et al. | |

FOREIGN PATENT DOCUMENTS

| | | | |
|---|---|---|---|
| CN | 2859987 | Y | 1/2007 |
| EP | 1 035 755 | A | 9/2000 |
| WO | 99/12400 | A1 | 3/1999 |

OTHER PUBLICATIONS

Office action from China counterpart application 201080016075.9 (Mar. 24, 2014).

* cited by examiner

MESSAGE CONTROLLABLE LAMP

FIELD OF THE INVENTION

The invention relates to a lamp, a lighting system comprising such a lamp and a method of operating a lighting system.

BACKGROUND OF THE INVENTION

It is known to use a communication network to control on/off switching of lamps. Each lamp has its own address and on/off switches are provided that are capable of triggering transmission of messages directed at selected ones of the these addresses to control selectable lamps. Lamps are mounted with a permanent connection to the mains power supply. In the lamp a message controlled mains switch is provided that couples or decouples the mains and a light producing element of the lamp, such as a LED, when a message addressed to the lamp is received.

Installation of such a system involves the establishment of a correspondence between the addresses of the lamps and the addresses used for different switches. In order to enable unskilled consumers to perform installation, it is desirable that installation is kept as simple as possible.

To support installation a lamp may be designed to assume the address of the first received message after mounting of the lamp. A user can install such a lamp by mounting the lamp and subsequently activating the on/off switch that will be used to control the lamp.

Sometimes, it is desirable to change the on/off switch that controls a lamp or to move a lamp to another location where it will be controlled by another on/off switch. It is desirable that such a re-installation is kept as simple as possible.

SUMMARY OF THE INVENTION

Among others it is an object to provide for simple re-installation of lamps.

A message controllable controlled lamp according to claim 1 is provided. This lamp comprises a power supply connector and a detector circuit that detects whether the power supply connector is in a power supply socket. The lamp contains a control circuit and a memory and the control circuit responds to detection that the power supply connector is not in the power supply socket by setting information in the memory to enable an update of an address in the memory. In an embodiment the lamp has an internal power source, such as a battery or a capacitor to provide operating power to the detector circuit and the control circuit at least temporarily after power is removed from the power supply connector.

By providing for internal enabling of an address update when the lamp is taken from a power supply socket, the lamp will automatically provide for reprogramming of the address when the lamp is detached from the socket. The address update may be performed automatically when the lamp is mounted into a socket again, for example by taking an address from a first received message after mounting that is appropriate for this purpose.

A detector for detecting whether the power supply connector is in a power supply socket may be configured to detect the presence of an object at a position relative to the connector that will be taken up by the socket when the lamp is in the socket. In an embodiment the detector comprises a resistance sensing circuit configured to detect whether the power supply connector is mounted by comparing a resistance between electrodes on a first power supply terminal of the lamp's power supply connector. Alternative solutions include an optical sensor in the lamp to detect a part of the socket, or a mechanical switch. Resistance measurement has the advantage that it is robust and easy to implement with little overhead.

In an embodiment the internal control circuit in the lamp may be configured to execute the update in response to detection that contact to a socket has been re-established after the update has been enabled. However, alternatively a further control circuit outside the lamp may be used to perform the update (e.g. a further control circuit in the power outlet socket into which the lamp is mounted). Thus a lighting system may be provided for that comprises a message controllable lamp as claimed, the lighting system comprising a power outlet socket for connection to the power supply connector, and a further control circuit configured to read the information to enable an update from the memory of the lamp, when the lamp is in the socket and to execute the update when the information indicates that the update has been enabled. By executing the update upon mounting of the lamp a minimum of additional actions from the user is required. Furthermore, unnecessary updates are avoided while the lamp is not mounted. Detection whether the lamp is mounted in the socket may be performed using the detector circuit that is also used to detect dismounting. Alternatively, detection of application of mains power supply to the lamp may be used to detect mounting.

In an embodiment the lamp comprises a receiver circuit and the control circuit is configured to write an address derived from a message received by the receiver circuit into the memory when the update is enabled and the lamp is mounted in the power supply socket. Alternatively, the receiver and or part of the control circuit may be located outside the lamp, e.g. in the power outlet socket into which the lamp is mounted. Thus a lighting system may be provided for wherein a further control circuit is configured to execute the update in response to detection that contact to a socket has been re-established after the update has been enabled.

In an embodiment the lamp comprises a switch coupled in series with the electric light source between the first and second power terminal and a control circuit that compares addresses from messages received by the receiver circuit with the stored address from the memory and controls said switch in response to selected ones of the messages that have received address matching the stored address. The switch may be used to switch the lamp on and off altogether, or do moderate electric current to the light source or to switch selected color components on or off etc. The address from the memory in the lamp is used to determine whether messages are directed at the lamp. Alternatively, the switch and/or control of switching may be performed outside the lamp, for example in the socket in which the lamp is mounted. A lighting system may be provided with a switch coupled in series with the electric light source when the lamp is mounted in the socket, a receiver circuit; and a further control circuit configured to compare further addresses from messages received by the receiver circuit with the stored address from the memory, and to control said switch in response to selected ones of the messages that have received address matching the stored address.

In an embodiment the receiver is configured to receive the message via a wireless medium. This simplifies wiring of the lighting system.

The lamp may comprise a programmable circuit, such as a microcontroller, that is programmed to perform the relevant actions.

BRIEF DESCRIPTION OF THE DRAWING

These and other objects and advantageous aspects will become apparent from a description of exemplary embodiments using the following Figures.

DETAILED DESCRIPTION OF EXEMPLARY EMBODIMENTS

Figure 1:
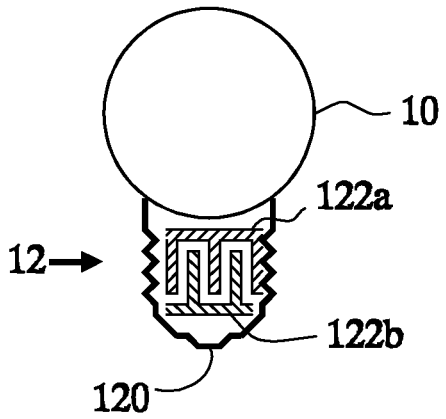
FIG. 1 shows a lamp

FIG. 1 shows a lamp comprising a light source part 10 and a connector part 12 for connecting the lamp to a mains power supply (not shown). In operation, the lamp may be installed into a system that contains control units (not shown) and mains power supply sockets (not shown) in which connector part 12 can be inserted. The control units may comprise transmitters to transmit messages addressed to the lamp.

Connector part 12 may have the shape of a conventional screw fitting. As is known per se, such a fitting roughly has the form of a truncated cylinder attached to the light source part 10, with a first electric power terminal 120 on the truncated surface of the cylinder and a second electric power terminal formed by the circumference of the cylinder, which has the form of a screw thread.

In the lamp of FIG. 1, the circumferential surface of the cylinder that forms the second electric power terminal comprises a first and second electrode 122*a,b*, and an electrically isolating area separating the first and second electrode 122*a, b*. By way of illustration first and second electrode 122*a,b* comprise interdigitated fingers, separated along lines that run parallel to the axis of the cylinder.

Figure 2:
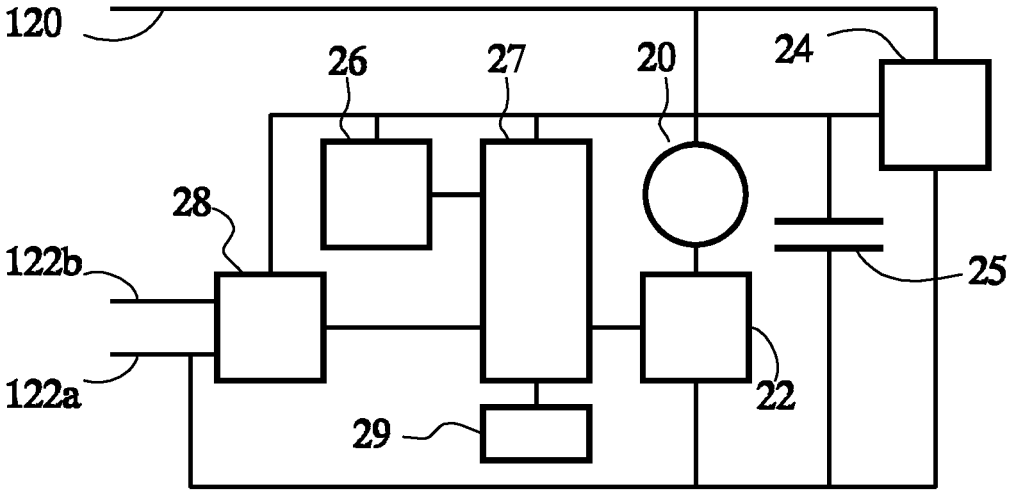
FIG. 2 shows an electric circuit within the lamp

FIG. 2 shows an exemplary electric circuit within the lamp. The circuit comprises the first electrical power terminal 120 and the first and second electrode 122*a,b*, a light source 20, a switch 22, a power converter 24, a supply capacitor 25, a receiver circuit 26, a control circuit 27, a detector circuit 28 and an address memory 29. Address memory 29 may be a non-volatile memory. Receiver circuit 26 may be a ZigBee receiver circuit for example. Light source 20 is coupled in series with switch 22 between first electric power terminal 120 and first electrode 122*a*. Power converter 24 has power supply inputs and a power supply output. The power supply inputs are coupled to first electric power terminal 120 and first electrode 122*a*. Supply capacitor 25 is coupled between first electrode 122*a* and the power supply output. Receiver circuit 26, control circuit 27 and detector circuit 28 have power supply inputs coupled to first electrode 122*a* and the power supply output. Control circuit 27 has inputs coupled to receiver circuit 26 and detector circuit 28. Control circuit 27 has a memory interface coupled to address memory 29. Control circuit 27 has an output coupled to a control input of switch 22.

In operation control circuit 27 controls switch 22 dependent on messages received by receiver circuit 26. An address in address memory 29 indicates which of the messages should be used to control switch. In addition an address update enable flag in address memory 29 indicates whether control circuit 27 should update the address in address memory 29. The address update enable flag may be realized as a separate bit, or it may be realized a specific dummy address value. In this case, if the address in address memory has the dummy value, this flags that updates are enabled, and if the address has another value this flags that updates are disabled.

Control circuit 27 uses a detection signal from detector circuit 28 to control changes the address update enable flag and address updates. Detector circuit 28 supplies this signal dependent on whether it detects an electrical connection between first and second electrode 122*a,b*. When the address update enable flag in address memory 29 indicates that an address update is enabled, and control circuit 27 detects that a message has been received while detector circuit indicates that a connection is present between first and second electrode 122*a,b*, control circuit 27 writes an address from a received message into address memory 29. Control circuit 27 may be configured to use an address from the first received message after detection of establishment of the connection for example.

Simultaneously or subsequently control circuit 27 sets the address update enable flag to a value that disables subsequent updates until further notice. In another embodiment control circuit 27 may be configured to modify the address update enable flag in response to a message containing a command to do so. This enables user control over the end of the time interval in which the address can be updated. When detector circuit 28 signals the absence of electrical connection between first and second electrode 122*a,b* indicates that the lamp has been disconnected, control circuit 27 sets the address update enable flag to enable an address update.

When connector part 12 is coupled to a mains supply, power converter 24 supplies power to receiver circuit 26, control circuit 27 and detector circuit 28. Receiver circuit 26 may be a wireless (RF) communication receiver for example. When receiver circuit 26 receives a message, it demodulates the message and supplies information derived from the message to control circuit 27. Control circuit 27 compares an address from the information with an address from address memory 29. If the address match, control circuit 27 controls switch 22 dependent on the message, for example by making switch conductive or non-conductive, so that light source 20 will emit light or not.

When detector circuit 28 signals control circuit 27 that the lamp has been removed from the socket and receiver circuit 26 indicates reception of a message, control circuit 27 tests whether the address update enable flag in address memory 29 indicates that an address update is enabled. If so, control circuit 27 writes an address from a received message into address memory 29 and simultaneously or subsequently control circuit 27 set the address update enable flag to a value that disables updates. When detector circuit 28 indicates the absence of a connection between first and second electrode 122*a,b* control circuit changes the address update enable flag to enable an address update.

Figure 3:
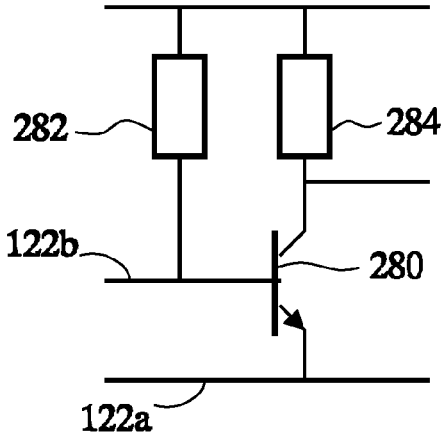
FIG. 3 shows a detector circuit

FIG. 3 shows an embodiment of the detector circuit wherein the detector circuit comprises a transistor 280, a bias resistor 282 and a load resistor 284. A bipolar NPN transistor 280 may be used for example. Transistor 280 has an emitter coupled to first electrode 122*a*, a base coupled to second electrode 122*b* and a collector coupled to the power supply output of power converter (not shown) via load resistor 284. Bias resistor 282 is coupled between the base and the power supply output of power converter.

In operation, when connector part 12 is screwed into a socket of a mains power supply, the socket short circuits first and second electrodes 122*a,b*, with the effect that the collector voltage of transistor 280 is substantially at the voltage level of the power supply output of power converter 24. This signals to control circuit 27 that the connector part 120 is connected to a socket. When connector part 12 is not in a socket, bias resistor 282 pulls the base of transistor 280 towards the voltage level of the power supply output of power converter 24. As a result the collector voltage of transistor 280 is substantially at the voltage level of the first electrode. This signals to control circuit that the connector part 120 is not connected to a socket.

As will be appreciated, this circuit effectively compares the resistance between first and second electrode with a threshold value, defined by transistor 280. The collector current of transistor 280 and consequently the voltage across load resistor 284 depends on this resistance. Control circuit 27 is activated when this voltage exceeds some logic threshold. However, it should be appreciated that any other resistance sensitive circuit may be used. For example, MOS transistor may be used instead of a bipolar transistor, a differential input circuit coupled to the electrodes 122*a,b* may be used, electrodes 122*a,b* may be part of an RC timing circuit whose delay time is measured to compare the resistance with a threshold etc.

To summarize, control circuit 27 updates an address in address memory 29 when a first condition is met that (a) the address update enable flag has a value that indicates that an update is enabled, (b) detector circuit 28 indicates that the lamp is in a socket and (c) a message with an address for use in the update has been received. The latter two may be combined if receiver circuit 26 is powered only using power received from the electrical power terminals of the lamp. Control circuit 27 changes the address update enable flag to disable subsequent updates when the address is updated.

Control circuit 27 sets the address update enable flag to enable an address update when a second condition is met that (a) the address update enable flag does not yet enable an update and (b) detector circuit 28 indicates that the lamp is not in the socket.

Control circuit 27 may be realized as a microcontroller, with a stored program to control its operation. As described this may involve address comparison, generation of control signals for switch 22, detection of conditions for an address update, address writing and detection of conditions for changing the address update enable flag. Alternatively, part or all of these operations may be implemented using dedicated hardware, such as logic gates to detect the conditions, a register for temporarily storing received addresses an address comparator etc.

Figure 4:
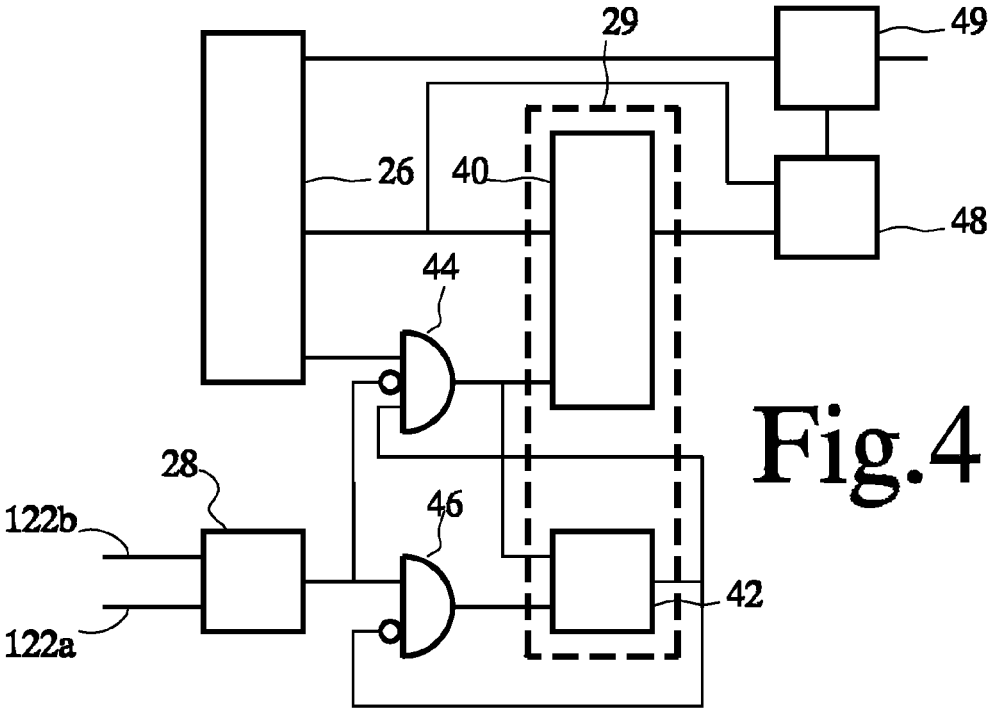
FIG. 4 shows a control circuit

FIG. 4 shows an example of a hardware embodiment, wherein memory 29 comprises memory locations 40 for an address and a memory location 42 for an address update enable flag. The control circuit comprises first and second logic gates 44, 46. Second logic gate 46 controls setting a value in memory location 42 for an address update enable flag when detector circuit 28 indicates disconnection and the flag is not yet set. Only detector circuit 28, second logic gate 46 and the memory location 42 for the address update enable flag need to receive power temporarily when the lamp has been disconnected. By way of example a first logic gate 44 is shown that controls address copying from receiver circuit 26 to the memory locations 40 for the address when the lamp is detected to be connected, the address update is enabled and receiver circuit 26 indicates that an address is available.

Additionally the control circuit may comprise an address comparator 48 and a command circuit 49. The address comparator 48 having inputs coupled to receiver circuit 26 and the memory locations 40 for the address, and an output coupled to an enable input of the command circuit 49. The command circuit 49 has an input coupled to an output of receiver circuit 28 for outputting a command part of a message and an output coupled to a control input of switch (not shown), for applying command signals dependent on the command, when enabled. Alternatively, all or part of the circuit may be implemented using a microcontroller. Thus control circuit 27 may comprise respective different parts for enabling the updates and for performing the update.

Although an embodiment has been shown wherein control circuit 27 is entirely comprised in the lamp, it should be appreciated that it may suffice that the address memory and the part of the control circuit that is used for enabling the update and are comprised in the lamp. The receiver and the part of control circuit that performs address dependent operation may be implemented in the socket in which the lamp is inserted, this part of the control circuit reading or writing the address memory in the lamp in the socket as needed. Similarly, switch 22 may be outside the lamp, as long as it is controlled using the address from the address memory inside the lamp.

Any kind of information may be used as address. The term "address" merely signifies that the information is used to distinguish between whether the lamp should respond to a message or not. In other words, the same message with the same address will elicit a response from a lamp or not, dependent on a result of comparing address information from the message with the stored address. Typically, an address also identifies a control unit (e.g. a user-operable switch, not shown) that has been selected to control the lamp. But in other examples, an address may identify a function (e.g. switch on porch light) that can be controlled from a plurality of control units. In this case storage of the address indicates that the lamp subsequently serves the relevant function.

Instead of a single address, a plurality of addresses may be used to control the lamp. In an embodiment, control circuit 27 is configured to compare an address from a received message with a plurality of addresses from address memory 29 and to control switch 22 if any one of the addresses from address memory 29 matches. This enables control by multiple control units (such as user operated switches not shown). To support programming of these addresses, control circuit 27 may be configured to write different update addresses from successive message into address memory 29, so that each can be retrieved. This may continue as long as the address update enable flag does not disable this. Control circuit 27 may be configured to modify the address update enable flag to disable writing a time interval of predetermined length after receiving the first such message for example, or in response to a message commanding control circuit to do so. When detector circuit 28 detects disconnection the address update enable flag is set to invalidate all of these addresses. In an embodiment, control circuit 27 may be configured to respond to detection by overwriting all addresses by default values, or writing bits to invalidate the addresses.

In an embodiment, control unit 27 extracts address information for storage in address memory 29 from normal operating messages, which control circuit 27 would otherwise use only for controlling the lamp. In another embodiment, special messages of a different type may be used to update the address. In this embodiment control circuit 27 is configured to determine the message type (for example by determining whether the message contains an address update command) and to use an address from the message to update the address only if the message is of a predetermined type. In this embodiment control units (not shown) may be used that can be operated by the user to select whether a message of this type must be transmitted.

Although an embodiment has been shown wherein the address update enable flag enables updates using addresses from subsequently received messages, it should be appreciated that in an alternative embodiment, control circuit 27 may buffer addresses from messages and an update using a buffered address from a previously received message may be used for the update. Optionally, this may be subject to a condition that the buffered address has not been received more than a predetermined amount of time before the update is enabled.

Although an embodiment has been described wherein electrodes are provided that each comprise a series of fingers that run parallel to the cylinder axis, with fingers from alternate ones of the electrodes along the circumference of the cylinder surface, it should be appreciated that any other electrode arrangements may be used that will result in a short circuit between the first and second electrode when the lamp is installed in a socket. The use of a plurality of fingers has the advantage that careful installation is not needed and limited damage to the electrodes will not affect operation. Alternative embodiments include first and second electrodes as respective rings on the lamp foot at different positions between the first electrical power terminal 120 and the light source part, half rings etc. Instead of electrodes, a mechanical switch may be used, located at a position on the lamp foot where it will be operated by pressure from the socket in which the lamp is mounted. As another alternative active detection may be used, for example using an optical sensor to detect light reflected from the socket. A photo-diode in the lamp base may be used for example, so that the photodiode receives light only through a part of the fitting that will be covered by the socket when the lamp is installed. If the lamp is in the fitting, the photodiode will always receive no light and if the lamp is out of the socket it will be light at least at some of the time and in this case the update is enabled. In another embodiment a strain-gauge on the lamp foot may be sued. The output of the strain gauge value of the resistor will change depending on whether the lamp is in the socket or not.

Although the first and second electrodes 122*a,b* are preferably electrically isolated from one another in the lamp, so that electrical connection between the electrodes must come from outside the lamp, it should be realized that it suffices that the first and second electrodes 122*a,b* are not always short circuited in the lamp. For example, the first and second electrodes 122*a,b* may be coupled by a resistance in the lamp, or an internal circuit in the lamp may short circuit the first and second electrode 122*a,b* during certain periods of time, interrupted by time intervals for measuring whether the electrodes are short circuited from outside the lamp. As used herein, the term "electrically separate" will be used to indicate the absence of a permanent short circuit in the lamp.

Although an embodiment has been described wherein on/off switching of the lamp is controlled dependent on the messages, it should be appreciated that messages may be used to control other functions such as changing light intensity or color content of the lamp. For this purpose, additional circuit elements may be included in addition to, or instead of switch 22. Control circuit 27 may select the type of control dependent on content of the messages with matching addresses.

In an alternative embodiment, control circuit 27 may be configured to control different control functions dependent on the addresses of the messages. In this case, address memory 29 may store a plurality of addresses, for respective control functions. This enables control of different functions by messages transmitted by different control units. In this embodiment, a plurality of address update enable flags may be stored in address memory 29, to enable and disable updating of respective ones of the addresses. Control circuit 27 may be configured to enable updating of all of these addresses when detector circuit 28 signals disconnection of the lamp from the socket, and to disable updating of the respective addresses individually, each when the respective address has been updated while detector circuit 28 signals that the lamp has been connected to the socket. The messages may contain information to select which of the stored addresses must be updated.

Although an embodiment has been described wherein a signal from detector circuit 28 is tested to determine whether the condition for updating the address is met (updates being executed only when the lamp is detected to be in the socket), it should be appreciated that alternatively, detection of power supply may be used as a condition for updating. Control circuit 27 may be configured to perform the update using an address from the first received message after power supply has become available.

In an alternative of the circuit of FIG. 2, power supply converter 24 has a power supply detection output coupled to control circuit 27. In this embodiment control circuit 27 may be configured to update the address when the condition is met that (a) the address update enable flag has a value that indicates that an update is enabled, (b) power supply converter 24 indicates that power is supplied between first electrical power terminal 120 and first electrode 122*a* and (c) a message with an address for use in the update gas been received. This solution has the advantage that accidental coincidences between short circuits between first and second electrode 122*a,b* and message transmissions cannot lead to address updates. Preferably this is combined with setting of the address update enable flag in response to detection that the lamp is out of the socket. An embodiment wherein the flag is also set in response to a power supply interruption may have the disadvantage that a (short) power failure will set the address update enable flag to a value that indicates that an update is enabled. This would necessitate, reprogramming of all lamps is needed.

Although an embodiment has been described wherein the lamp contains no transmitter, it should be appreciated that alternatively the lamp may comprise a transmitter and control circuit 27 may be configured to cause that transmitter to transmit messages such as acknowledgments. Although an example has been shown that uses wireless message transmission (RF transmission for example), it should be appreciated that alternatively power line message transmission may be used, receiver circuit 26 inputting messages from voltages between first electrical power terminal 120 and first electrode 122*a*.

Although an embodiment has been shown with a power converter 24 and a supply capacitor 25 used to maintain operating power to perform the action of setting the address update enable flag, it should be appreciated that alternatively a battery may be used in the lamp to support setting the address update enable flag. When a battery is used, address memory 29 need not be a non-volatile memory: it may be powered from the battery. Although a single address memory 29 has been shown, it should be appreciated that instead a plurality of memories may be used and that more information that just address information may be stored in address memory 29.

Although an embodiment has been shown wherein the address update enable flag is set to enable updates in response to detection of disconnection of the lamp from a socket (not shown), it should be appreciated that additionally the address update enable flag may be set in response to received messages. In this embodiment control circuit 27 is configured to detect whether a received message is a command to set the address update enable flag to an enable address update and, if so, to set the address update enable flag.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A message controllable lamp, comprising:

a power supply connector with a first and second power terminal and an electric light source, coupled between the first and second terminal;

a detector circuit coupled to the power supply connector and configured to detect whether the power supply connector is in a power supply socket, a control circuit and a memory, the control circuit having an input coupled to the detector circuit, the control circuit being configured to respond to detection that the power supply connector is not in the power supply socket by setting information in the memory to enable an update of an address in the memory, wherein the lamp receives control messages from the address.

2. The message controllable lamp according to claim 1, wherein the first terminal comprises a first electrode and a second electrode, electrically separate from each other in the lamp, the detector circuit being a resistance sensing circuit configured to detect whether the power supply connector is mounted by comparing a resistance between the first electrode and the second electrode with a threshold value.

3. The message controllable lamp according to claim 1, comprising an internal power source that is configured to provide operating power to the detector circuit and the control circuit at least temporarily after power is removed from the power supply connector.

4. The message controllable lamp according to claim 1, wherein the control circuit is configured to execute the update in response to detection that contact to a socket has been re-established after the update has been enabled.

5. The message controllable lamp according to claim 1, wherein the lamp comprises:

a receiver circuit;

the control circuit being configured to write an address derived from a message received by the receiver circuit into the memory when the update is enabled and the lamp is mounted in the power supply socket.

6. The message controllable lamp according to claim 5, wherein the lamp comprises a switch coupled in series with the electric light source between the first and second power terminal, the control circuit being configured to compare further addresses from further messages received by the receiver circuit with the stored address from the memory, and to control said switch in response to selected ones of the messages that have received address matching the stored address.

7. The message controllable lamp according to claim 5, wherein the control circuit is configured to determine the re-establishment from the output of the detector circuit.

8. The message controllable lamp according to claim 5, wherein the receiver circuit is configured to receive the message via a wireless medium.

9. The lighting system comprising a message controllable lamp according to claim 1, the power supply socket and a transmitter configured to transmit a message with an address for use by the lamp.

10. The message controllable lamp according to claim 1, wherein the address points to a device external to the message controllable lamp.

11. The message controllable lamp according to claim 1, wherein the lamp receives control messages from the address over a power line.

12. A method of controlling a lamp, the lamp comprising a memory that stores an address for selecting messages to control the lamp, the method comprising:

detecting disconnection of the lamp from a power supply socket, the detection being performed within the lamp;

setting information that enables an update of the address in the memory in response to detection of said disconnection;

updating the address on condition that the update is enabled, when the lamp is again connected to a power supply socket; and wherein the lamp receives control messages from the address.

13. A method according to claim 12, wherein the lamp has first and second power terminals, a light source being coupled between the power terminals, the first power terminal comprising a first electrode and a second electrode that are electrically separate within the lamp, said step of detecting comprising comparing a resistance between the first and second electrodes with a threshold value.

14. A computer program product, comprising a set of instructions for a programmable processor in a lamp, which when executed by the programmable processor causes the processor to input a signal from a detector within the lamp for detecting disconnection of the lamp from a power supply socket;

set information that enables an update of an address in a memory in the lamp in response to detection of said disconnection;

update the address on condition that the update is enabled, when the lamp is again connected to a power supply socket; and wherein the lamp receives control messages from the address.

* * * * *